US008136500B2

(12) United States Patent
Ochiai et al.

(10) Patent No.: US 8,136,500 B2
(45) Date of Patent: Mar. 20, 2012

(54) INTERNAL COMBUSTION ENGINE

(75) Inventors: Shuichi Ochiai, Saitama (JP); Yukihiro Tsubakino, Saitama (JP); Shinya Nishiyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 414 days.

(21) Appl. No.: 12/509,842

(22) Filed: Jul. 27, 2009

(65) Prior Publication Data

US 2010/0024760 A1 Feb. 4, 2010

(30) Foreign Application Priority Data

Jul. 31, 2008 (JP) ..... 2008-197885

(51) Int. Cl.
*F01M 1/02* (2006.01)

(52) U.S. Cl. ..... 123/196 R; 123/196 M; 184/6.21; 184/6.23; 184/7.3; 184/11.1

(58) Field of Classification Search ..... 123/196 R, 123/196 CP, 196 M, 73 V; 184/6.21, 6.23, 184/7.3, 11.1
See application file for complete search history.

(56) References Cited

U.S. PATENT DOCUMENTS

| | | | | |
|---|---|---|---|---|
| 5,467,843 | A * | 11/1995 | Esch et al. | 184/6.5 |
| 6,202,621 | B1 | 3/2001 | Inumaru et al. | |
| 6,343,584 | B1 | 2/2002 | Kudou et al. | |
| 6,578,541 | B2 | 6/2003 | Stromsky et al. | |
| 6,786,188 | B1 * | 9/2004 | Kawamoto | 123/196 R |
| 6,823,829 | B1 * | 11/2004 | Kawamoto et al. | 123/196 R |
| 2003/0017766 | A1 * | 1/2003 | Gokan et al. | 440/88 |
| 2003/0037775 | A1 * | 2/2003 | Gokan | 123/572 |
| 2004/0069260 | A1 * | 4/2004 | Fujikubo | 123/90.31 |
| 2004/0069266 | A1 * | 4/2004 | Fujikubo | 123/196 R |
| 2004/0244760 | A1 * | 12/2004 | Kawamoto et al. | 123/196 R |
| 2005/0011483 | A1 * | 1/2005 | Takeuchi | 123/196 R |
| 2007/0272195 | A1 * | 11/2007 | Keyaki et al. | 123/196 R |

FOREIGN PATENT DOCUMENTS

| | | | |
|---|---|---|---|
| DE | 10029844 | A1 | 1/2002 |
| FR | 2783278 | A1 | 3/2000 |
| FR | 2791734 | A1 | 10/2000 |
| JP | 2005-061386 | A | 3/2005 |

* cited by examiner

*Primary Examiner* — Michael Cuff
*Assistant Examiner* — Hung Q Nguyen
(74) *Attorney, Agent, or Firm* — Birch, Stewart, Kolasch & Birch, LLP

(57) ABSTRACT

An internal combustion engine in which it can be made difficult for bubbles to mix into oil in a flowing-down process of the oil. In a generator chamber, a shielding rib is provided which is disposed between a generator and an oil introduction port in side view and which extends skewly upwardly from the oil introduction port in a manner so as to cover one end side of the oil introduction port. A guide rib extends from a side wall of the generator chamber in the manner of covering the other end side of the oil introduction port.

20 Claims, 11 Drawing Sheets

INTERNAL COMBUSTION ENGINE

CROSS-REFERENCE TO RELATED APPLICATIONS

The present application claims priority under 35 USC 119 to Japanese Patent Application No. 2008-197885 filed on Jul. 31, 2008 the entire contents of which are hereby incorporated by reference.

BACKGROUND OF THE INVENTION

1. Field of the Invention

The present invention relates to an internal combustion engine having a lubrication structure for circulating oil.

2. Description of Background Art

An internal combustion engine is known wherein a lubrication structure is provided for circulatorily supplying oil to sliding parts. In such an internal combustion engine, a structure has been adopted in which the oil is supplied to the sliding parts (e.g., a generator, a cam chain, etc.) by use of an oil pump. The oil lubricates the sliding parts and flows down into an oil sump chamber provided at a lower part of the crankcase. The oil that flows down into and is reserved in the oil sump chamber is pumped up by the oil pump, and is again circulatorily supplied to the sliding parts. See, for example, Japanese Patent Laid-open No. 2005-61386.

In order to maintain the lubricating performance of oil, it is preferable to prevent bubbles from being contained in the oil. However, in the above-mentioned lubrication structure for circulating the oil to the sliding parts bubbles may be mixed into the oil during the oil flows down. Thus, the bubbles mixed in the oil in the oil sump chamber may be pumped up by the oil pump. More specifically, when the splashed oil comes directly into an oil introduction port of the oil sump chamber, the splashed oil impinges on the oil being reserved, making it easier for the bubbles to mix into the oil.

SUMMARY AND OBJECTS OF THE INVENTION

The present invention has been made in consideration of the above-mentioned circumstances, and it is an object of the invention to provide an internal combustion engine in which it is difficult for bubbles to mix into the oil during a flowing-down process of the oil.

In order to attain the above object, according to an embodiment of the present invention, there is provided an internal combustion engine including a generator chamber which is provided at a side part of a crank chamber and in which a cam chain and a generator are disposed. An oil sump chamber is provided which has an oil introduction port for receiving a lubricating oil coming from the generator chamber and which reserves the oil received through the oil introduction port, with a generator being disposed on the upper side of one end side of the oil introduction port, and with a side wall of the generator chamber extending on the upper side of the other end side of the oil introduction port. In the generator chamber, there is provided a shielding rib which is disposed between the generator and the oil introduction port in side view and which extends skewly upwardly from the oil introduction port in the manner of covering one end side of the oil introduction port. A guide rib extends from the side wall of the generator chamber in the manner of covering the other end side of the oil introduction port.

According to this configuration, it can be made difficult, by the shielding rib, for the oil splashed from the generator to directly enter the oil introduction port. In addition, it can be made difficult, by the guide rib, for the oil splashed inside the generator chamber to directly enter the oil introduction port.

In addition, a bottom wall of the generator chamber may be formed at such an inclination so as to gradually rise from the one end side of the oil introduction port, and the shielding rib may be provided with a groove for guiding the oil from the bottom wall to the oil introduction port.

According to this configuration, the oil collected at the bottom wall of the generator chamber flows along the inclination to one end side of the shielding rib, and is then guided along the groove into the oil introduction port.

Furthermore, the guide rib may be disposed so as to be above the shielding rib in the vertical direction and to overlap with the shielding rib in side view, and may be formed at such a downward inclination that an end part in the extension direction of the guide rib is located below the center of a crankshaft.

According to this configuration, the oil collected by the guide rib is further collected by the shielding rib. In addition, the oil splashed during the course of the cam chain coming into mesh with the sprocket provided on the crankshaft is received by the guide rib.

In the internal combustion engine according to an embodiment of the present invention, in the generator chamber, a shielding rib is provided which is disposed between the generator and the oil introduction port in side view and which extends skewly upwardly from the oil introduction port in the manner of covering one end side of the oil introduction port. A guide rib extends from a side wall of the generator chamber in the manner of covering the other end side of the oil introduction port. Therefore, the oil splashed from the generator is shielded by the shielding rib, and flows down the shielding rib to the oil introduction port. Consequently, oil is prevented from directly entering the oil introduction port of the oil sump chamber, and the generation of bubbles in the oil due to impingement of the splashed oil on the reserved oil can be prevented from occurring. In addition, as for the oil splashed inside the generator chamber, the oil is collected by the guide rib and is guided to the oil introduction port. This also ensures that generation of bubbles in the oil due to impingement of the splashed oil on the reserved oil can be prevented from occurring.

In addition, a bottom wall of the generator chamber is formed at such an inclination so as to gradually rise from one end side of the oil introduction port, and the shielding rib is provided with a groove for guiding the oil from the bottom wall to the oil introduction port. Therefore, the oil collected at the bottom wall of the generator chamber flows along the inclination to one end side of the shielding rib, and is thereafter guided through the groove to the oil introduction port. Accordingly, the oil can be guided to the oil introduction port while preventing such a strong impingement (collision) that bubbles would mix into the oil.

Further, the guide rib is disposed so as to be above the shielding rib in the vertical direction and to overlap with the shielding rib in side view, and is formed at such a downward inclination that an end part in the extension direction of the guide rib is located below the center of a crankshaft. Therefore, the oil collected by the guide rib flows down onto the shielding rib, to be farther collected by the shielding rib. Accordingly, oil can be guided to the oil introduction port while obviating such a strong impingement (collision) that bubbles would mix into the oil. In addition, the guide rib receives the oil splashed during the course of the cam chain coming out of engagement with the sprocket provided on the crankshaft. Therefore, the oil can be received by the guide rib in its course of being splashed most. Consequently, the splashed oil can be prevented from impinging on the oil reserved in the oil sump chamber, and generation of bubbles in the oil can be obviated thereby.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
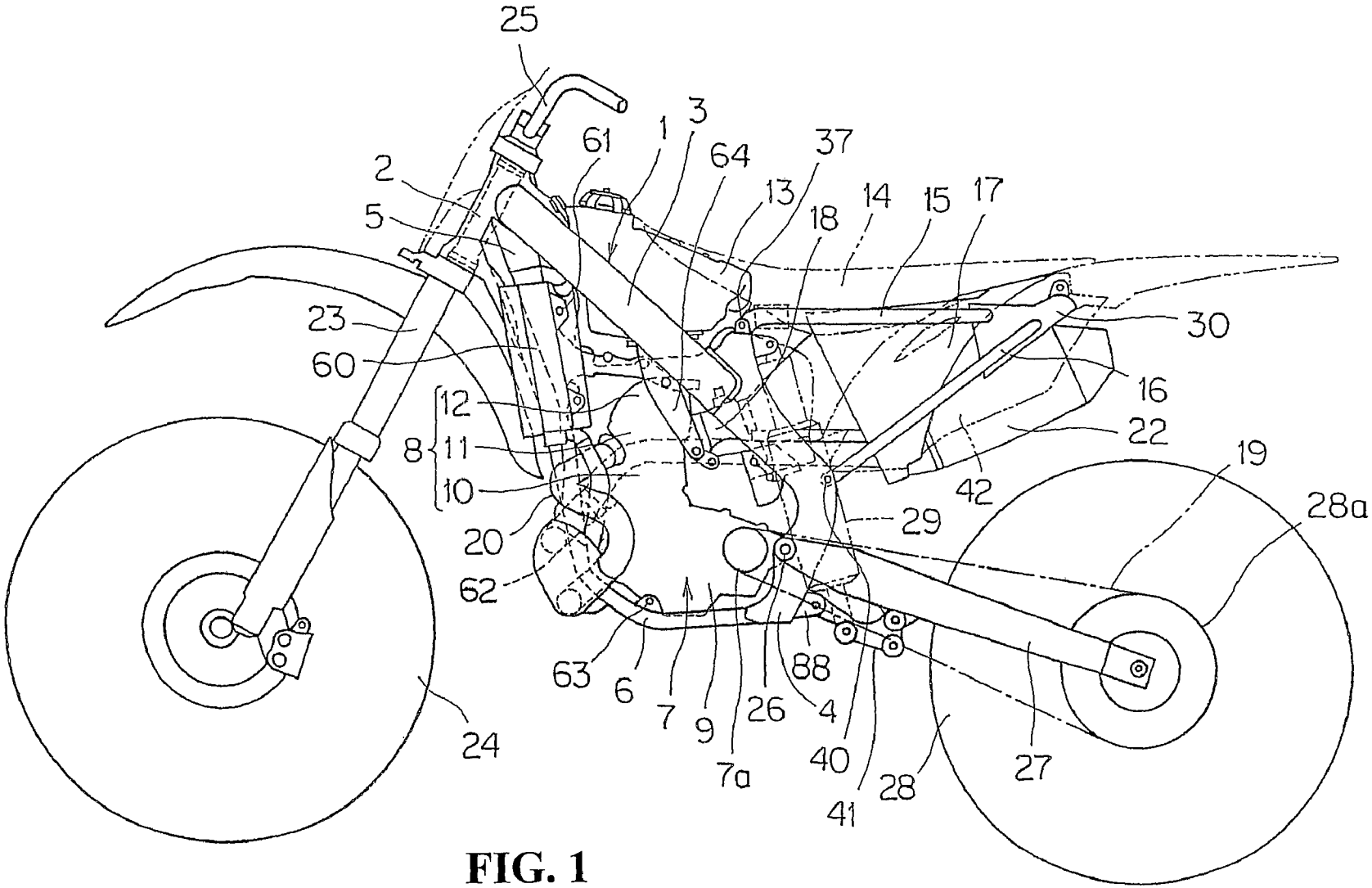
FIG. 1 is a side view of a motorcycle according to an embodiment of the present invention.

Now, an internal combustion engine according to an embodiment of the present invention will be described below referring to the drawings. Reference to upward and downward, forward and rearward, and leftward and rightward directions in the following description refer to the directions as viewed from the driver.

FIG. 1 is a side view of an offroad motorcycle according to an embodiment of the present invention.

A body frame 1 of this motorcycle includes a head pipe 2, main frames 3, center frames 4, a down frame 5 and lower frames 6, which are connected to one another in a loop form with an engine 7 supported on the inside thereof. The engine 7 has a cylinder 8 and a crankcase 9. The main frames 3, the center frames 4 and the lower frames 6 are provided in left-right pairs, whereas the head pipe 2 and the down frame 5 are provided as single members along the center of the vehicle body.

The main frames 3 extend over the engine 7 rectilinearly and downwardly rearwards, and are connected to upper end parts of the center frames 4 which extend vertically on the rear side of the engine 7. The down frame 5 extends skewly downwardly on the front side of the engine 7, and is connected to front end parts of the lower frames 6 at its lower end part. The lower frames 6 are bent from a front side lower part of the engine 7 toward the lower side of the engine 7, extend substantially rectilinearly rearwards, and are connected to lower end parts of the center frames 4 at their rear end parts.

The engine 7 is of a water-cooled four-cycle system. The cylinder 8 is provided at a front part of the crankcase 9 in an upright state with its axis substantially vertical, and has a cylinder block 10, a cylinder head 11, and a head cover 12 in this order from the lower side toward the upper side. With the cylinder 8 thus set upright, the engine 7 is made short in the front-rear direction, and the engine 7 is suited to an offroad vehicle.

A fuel tank 13 is disposed on the upper side of the engine 7, and is supported on the main frames 3. An incorporated type fuel pump (see FIG. 7) is contained in the inside of the fuel tank 13, and a high-pressure fuel is supplied from the fuel pump to a throttle body 18 through a fuel supply pipe.

A seat 14 is disposed on the rear side of the fuel tank 13, and is supported on seat rails 15 extending rearwardly from the upper ends of the center frame 4. Rear frames 16 are disposed on the lower side of the seat rails 15. An air cleaner 17 is supported by the seat rails 15 and the rear frames 16, and intake into the cylinder head 11 is conducted through the throttle body 18 from the vehicle body rear side.

An exhaust pipe 20 is provided at a front part of the cylinder 8. The exhaust pipe 20 extends from the front part of the cylinder 8 toward the front side of the crankcase 9, is bent to the right side, and is laid to extend rearwards on the right side of the vehicle body. A muffler 22 extends rearwards from the exhaust pipe 20. A rear end part of the muffler 22 is supported by the rear frames 16.

A front fork 23 is supported by the head pipe 2, and a front wheel 24 supported by lower end parts of the front fork 23 is steered by a handle 25. A front end part of a rear arm 27 is swingably supported on the center frames 4 by a pivot shaft 26. A rear wheel 28 is supported on a rear end part of the rear arm 27, and is driven by a drive chain 19 wrapped around a drive sprocket 7*a* of the engine 7 and a driven sprocket 28*a* on the rear wheel 28. A shock absorber 29 of rear suspension is provided between the rear arm 27 and rear end parts of the center frames 4.

As illustrated in FIG. 1, symbol 60 denotes a radiator 60 is provided together with a rubber mount part 61 thereof, engine mount parts 62 and 63, and an engine hanger 64. In addition, the engine 7 is supported on the center frames 4 also through the pivot shaft 26.

Figure 2:
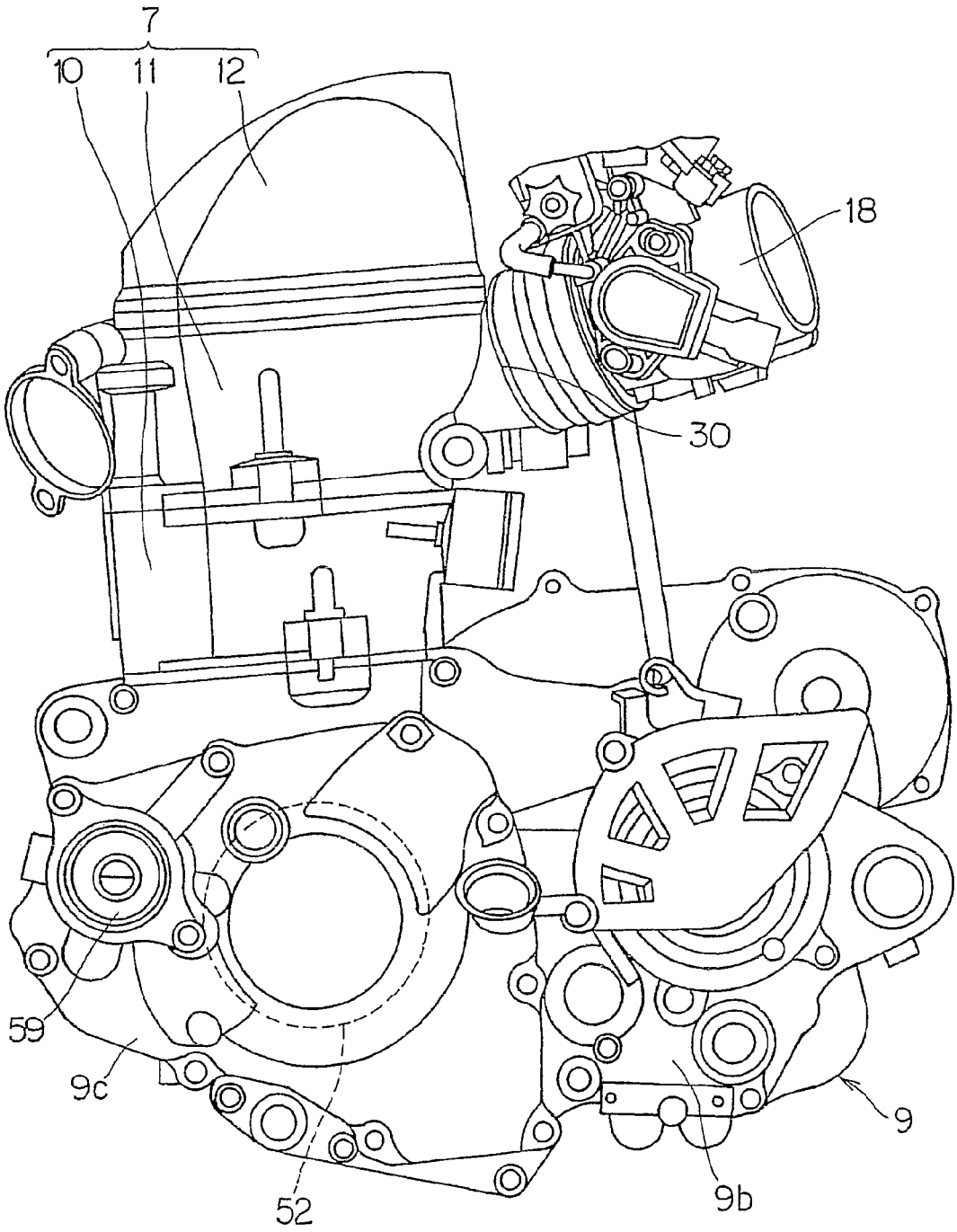
FIG. 2 is a side view of a water-cooled four-cycle single-cylinder engine.
Figure 3:
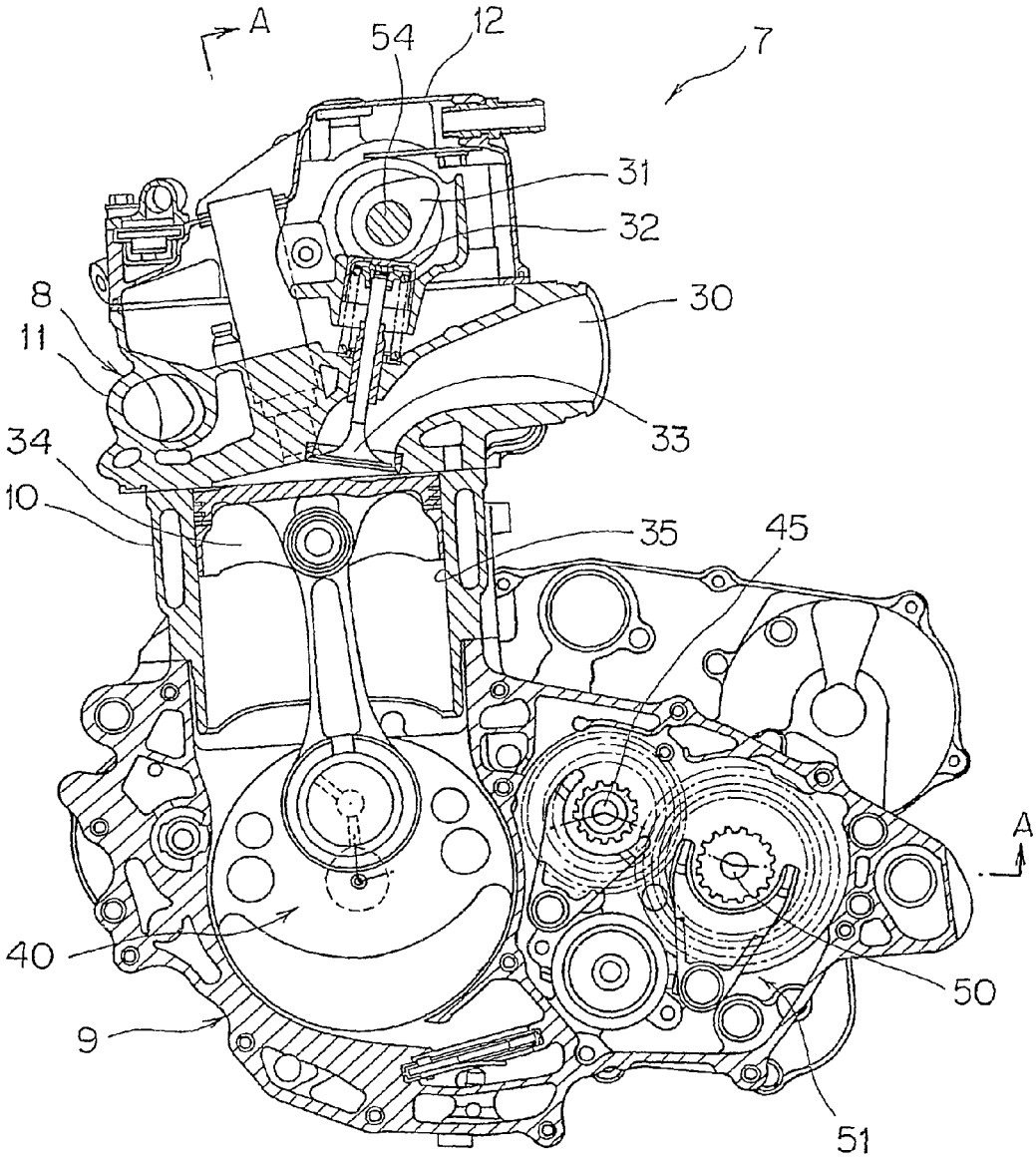
FIG. 3 is a side part sectional view of the engine.
Figure 4:
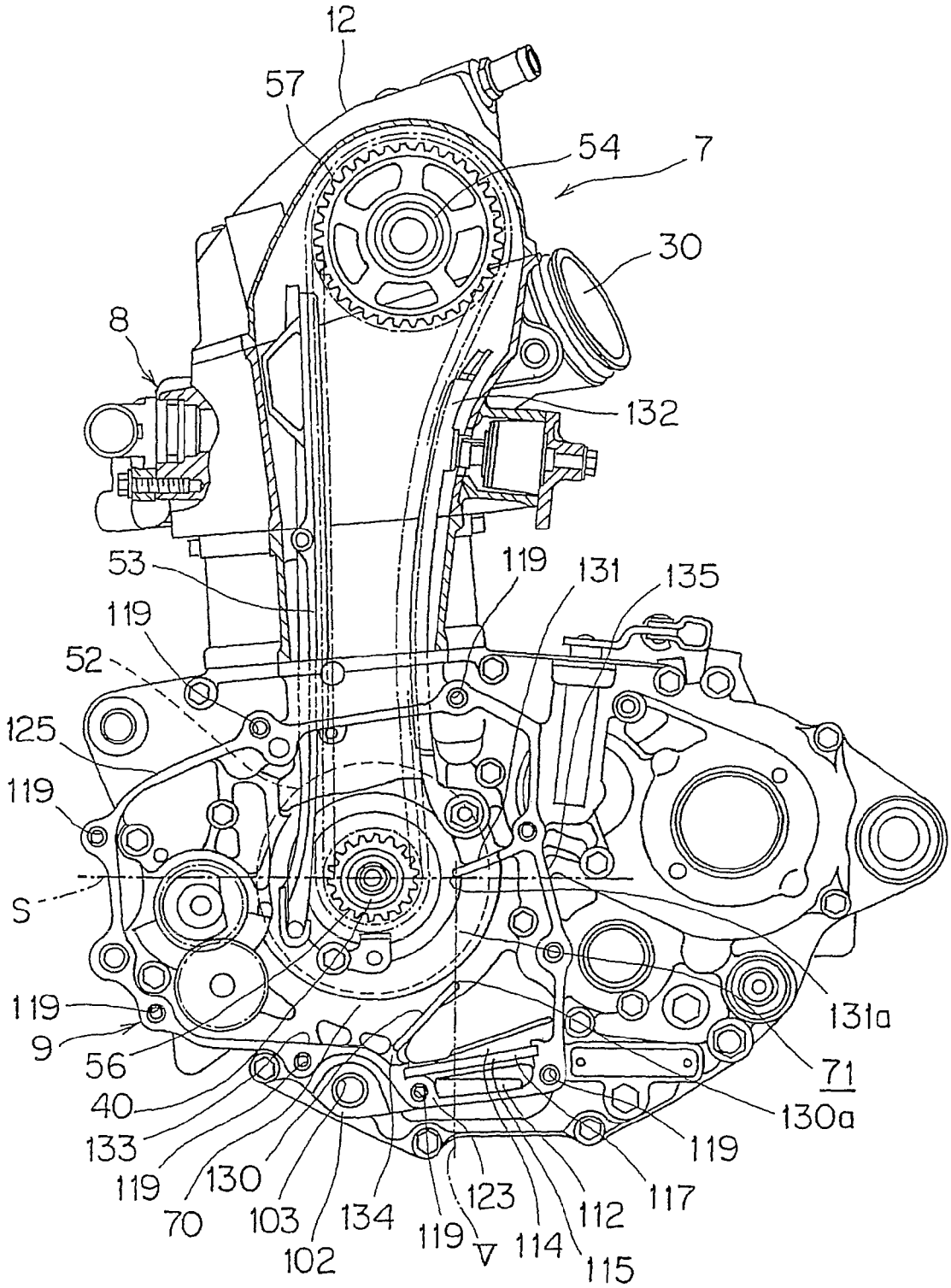
FIG. 4 is a partial sectional view of the engine, showing a generator chamber.
Figure 5:
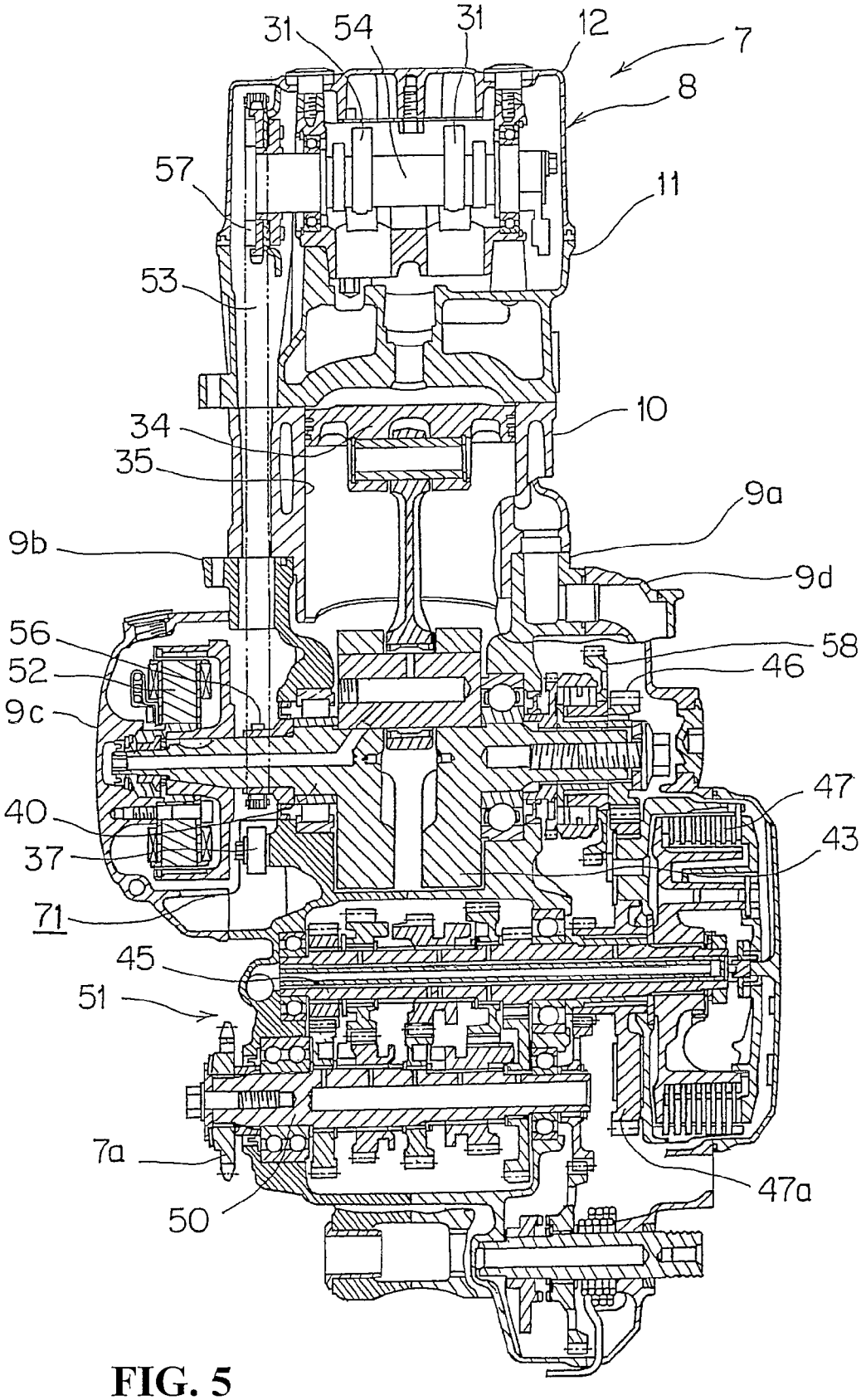
FIG. 5 is a sectional view taken along line A-A of FIG. 3.

FIG. 2 is a side view of the water-cooled four-cycle single-cylinder engine 7, FIG. 3 is a side part sectional view of the engine 7, FIG. 4 is a partial sectional view of the engine 7, showing a generator chamber 71, and FIG. 5 is a front view of FIG. 3, specifically, a sectional view taken along line A-A of FIG. 3.

The engine 7 is composed of the cylinder block 10, the cylinder head 11, the head cover 12, and the crankcase 9, as above-mentioned. The crankcase 9 is assembled by a method in which a right-side case 9*a* and a left-side case 9*b*, provided as a pair being splittable in the vehicle body width direction, are coupled to each other at mating surfaces 80*a*, 80*b* (for details, see FIGS. 6 and 7) orthogonal to the rotational axis of the crankshaft 40. A crankcase cover 9*c* is attached to a left side surface of the crankcase 9 through a gasket (not shown), and a right-side case cover 9*d* (see FIG. 5) is attached to a right side surface of the crankcase 9.

The cylinder head 11 is provided, on the vehicle body rear side thereof, with an intake port 30 through which a fuel-air mixture from the throttle body 18 is supplied into the engine 7. The intake port 30 is opened and closed through an intake valve 33 moved up and down by a cam 31 and a valve lifter 32 both provided inside the head cover 12, and the fuel-air mixture is supplied into a combustion chamber. Similarly, the cylinder head 11 is provided with an exhaust port (not shown) on the vehicle body front side thereof, and a combustion gas generated in the combustion chamber is exhausted through the exhaust port.

The cylinder block 10 is provided with a cylinder part 35 in which a piston 34 can be reciprocated in the vertical direction (more accurately, a direction slightly inclined toward a front upper side).

On the other hand, as shown in FIG. 3, a crankshaft 40, located on the lower side of the piston 34, a main shaft 45 located on the vehicle body rear side of the crankshaft 40, and a drive shaft 50 located further on the vehicle body rear side of the main shaft 45 are provided inside the crankcase 9. Rotational axes of the crankshaft 40, the main shaft 45, and the drive shaft 50 are disposed parallel to one another, and motive power is transmitted to them by gears which will be described later.

In addition, a primary reduction gear 46 rotated together with the crankshaft 40 is provided at a part on the vehicle body right side of the crankshaft 40. The primary reduction gear 46 is meshed with a housing gear 47*a* of a multiple disk clutch 47 disposed on the main shaft 45. This ensures that the rotational power of the crankshaft 40 is transmitted through the primary reduction gear 46 and the multiple disk clutch 47 to the main shaft 45.

As shown in FIG. 5, a generator 52 is attached to a left end part of the crankshaft 40. The generator 52 is located on the left side of the crankcase 9. A left outside part of the generator 52 is covered by a crankcase cover 9*c*.

In addition, a cam chain 53 for transmitting the power of the crankshaft 40 to a camshaft 54 is disposed on the inner side (the cylinder head side) of the generator 52. The cam chain 53 is wrapped around a crankshaft sprocket 56 provided on the crankshaft 40 and a cam sprocket 57 provided on the camshaft 54, so as to transmit power to the camshaft 54.

In addition, an oil pump 86 (indicated by dotted line in FIG. 6) for supplying a lubricating oil to sliding parts (a shaft part of the crankshaft 40, sliding parts of the cam chain 53 and the generator 52, and the like) inside the engine 7 is attached to the crankcase 9. The oil pump 86 is driven by power obtained from a pump gear 58 (see FIG. 5) provided on the crankshaft 40. In addition, as shown in FIG. 2, an oil filter 59 is attached to the crankcase cover 9*c*, and an oil pump 86 is provided on the depth side of the oil filter 59 shown in FIG. 2 (on the side of the inside of the engine 7).

The cam chain 53, the crankshaft sprocket 56, and the cam sprocket 57 mentioned above are disposed in a generator chamber 71 partitioned at a left side part of the crank chamber by a wall part 70. The generator chamber 71 is so configured that the oil having lubricated the camshaft 54 flows down to a lower part of the engine 7.

In the inside of the generator chamber 71, a generator 52 is provided. In addition, in the generator chamber 71, as shown in FIG. 4, the cam chain 53 runs, and the lubricating oil coming mainly from the generator 52 and the cam chain 53 flows down into the oil introduction port 115, and passes through a strainer 117 into an oil sump chamber 100. In addition, the detailed structures of the oil introduction port 115, the strainer 117, and the oil sump chamber 100 will be described later.

Figure 6:
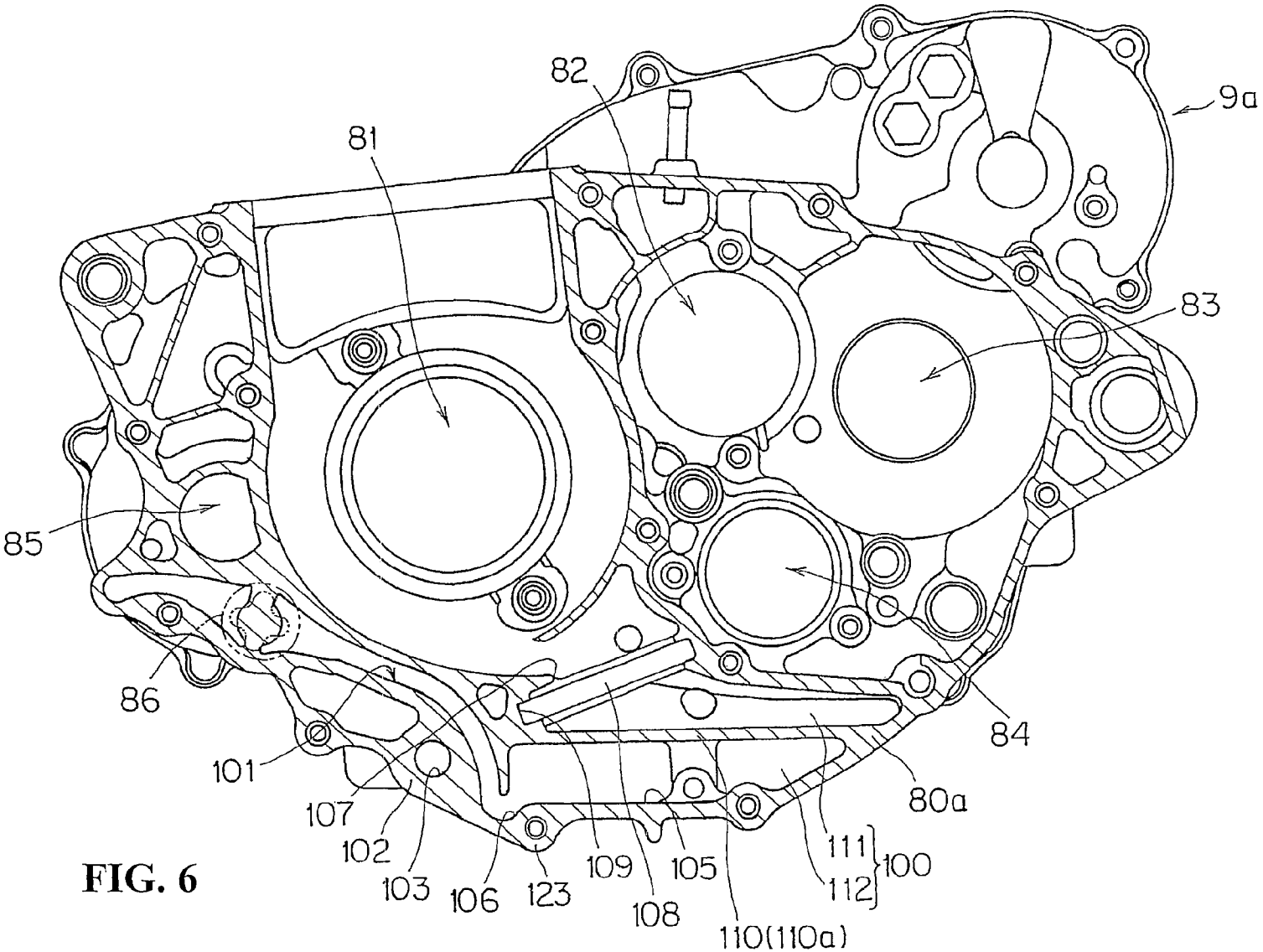
FIG. 6 is a view of a right-side case as a crankcase half, as viewed from the mating surface side.
Figure 7:
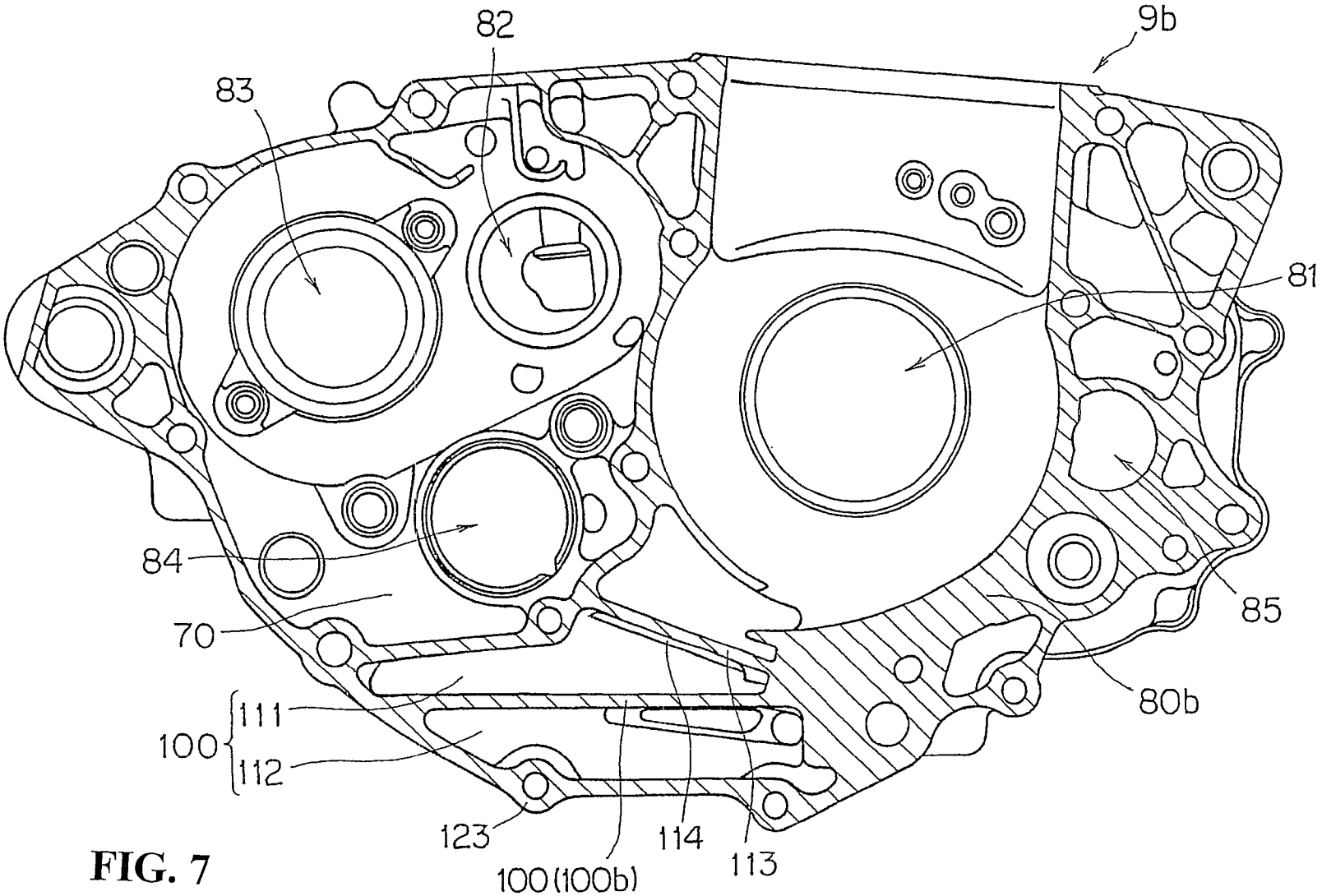
FIG. 7 is a view of a left-side case as a crankcase half, as viewed from the mating surface side.

FIG. 6 is a side view of the right-side case 9*a* of the crankcase 9 as viewed from the mating surface 80*a* side, and FIG. 7 is a side view of the left-side case 9*b* as viewed from the mating surface 80*b* side. In addition, the mating surface 80*a* shown in FIG. 6 and the mating surface 80*b* shown in FIG. 7 are hatched for permitting easy confirmation of these surfaces.

Figure 8:
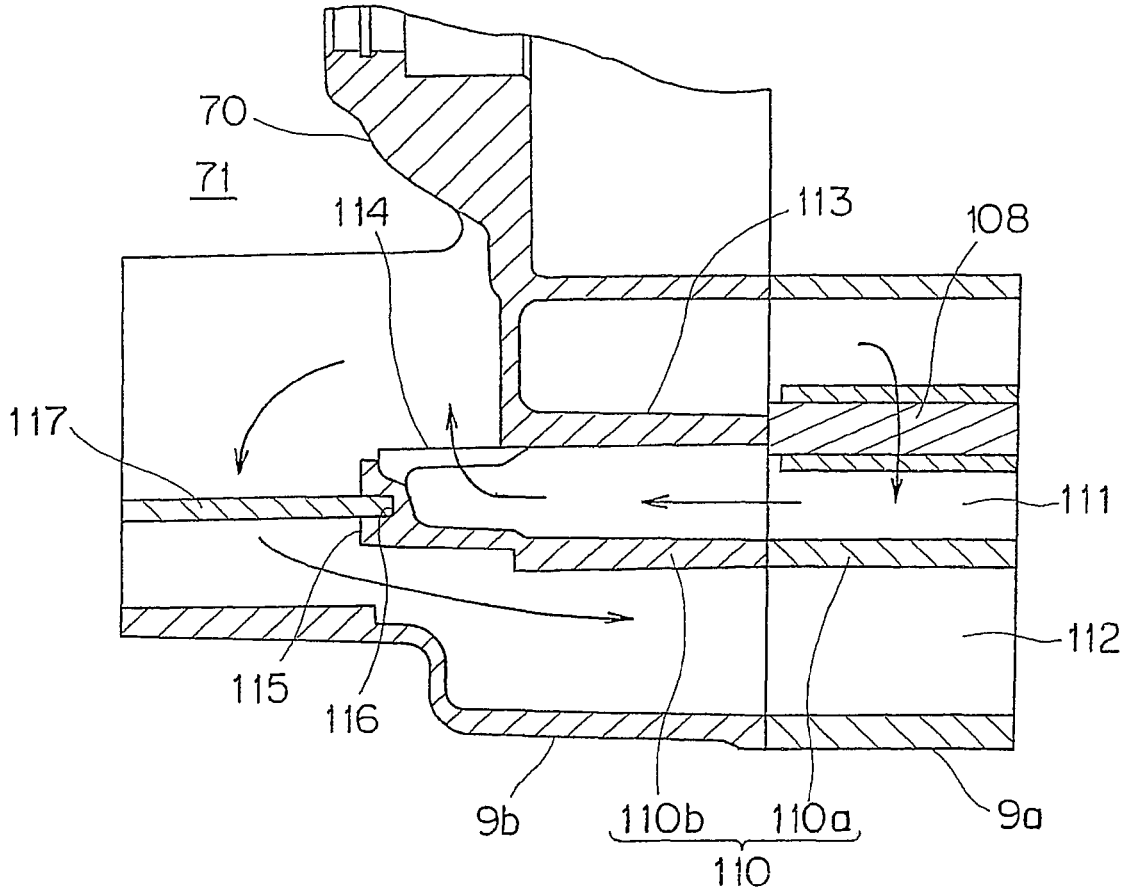
FIG. 8 is a schematic illustration of the flow of an oil in a lower part of a crankcase.
Figure 9:
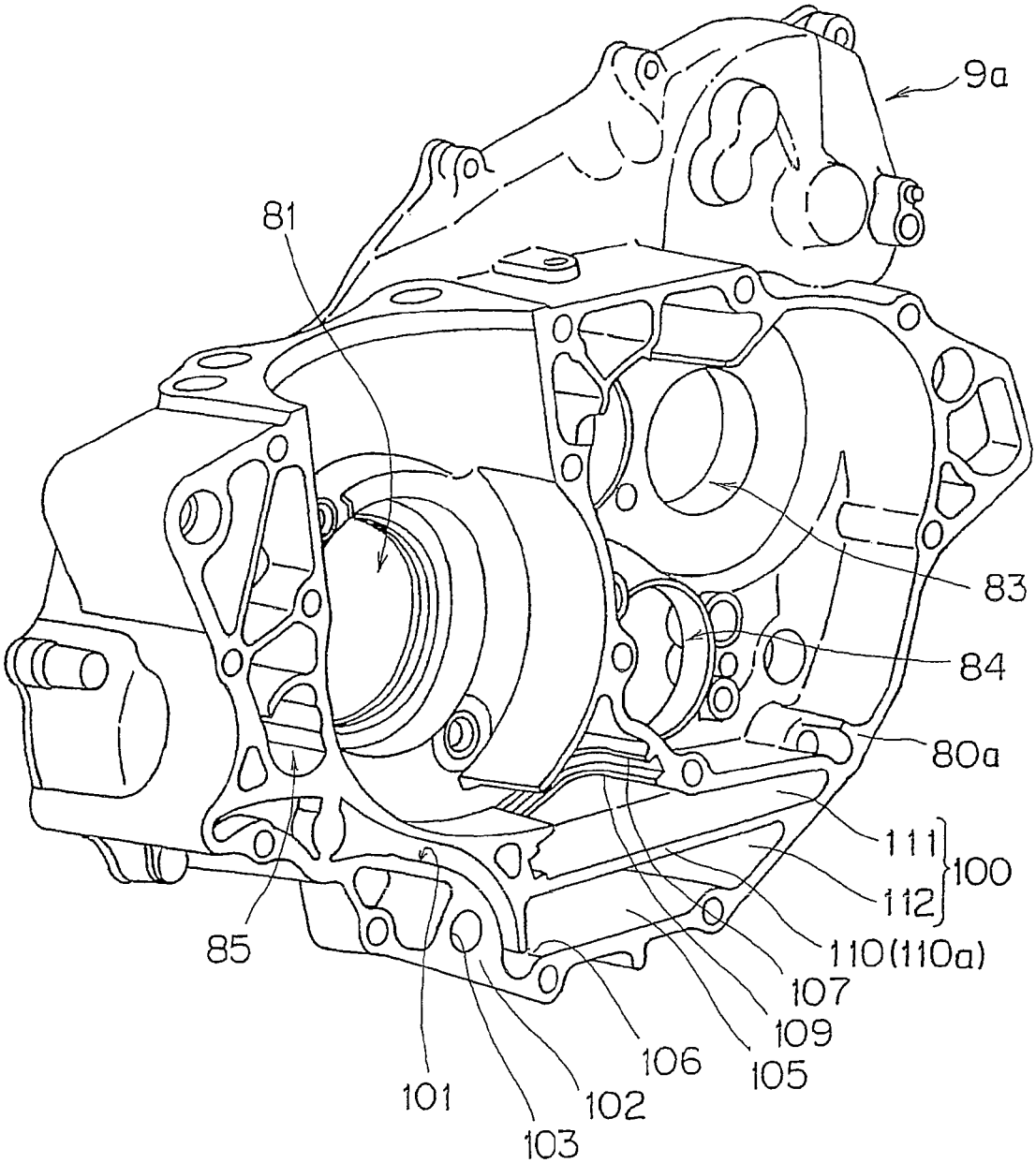
FIG. 9 is a perspective view of the right-side case as viewed from the mating surface side.
Figure 10:
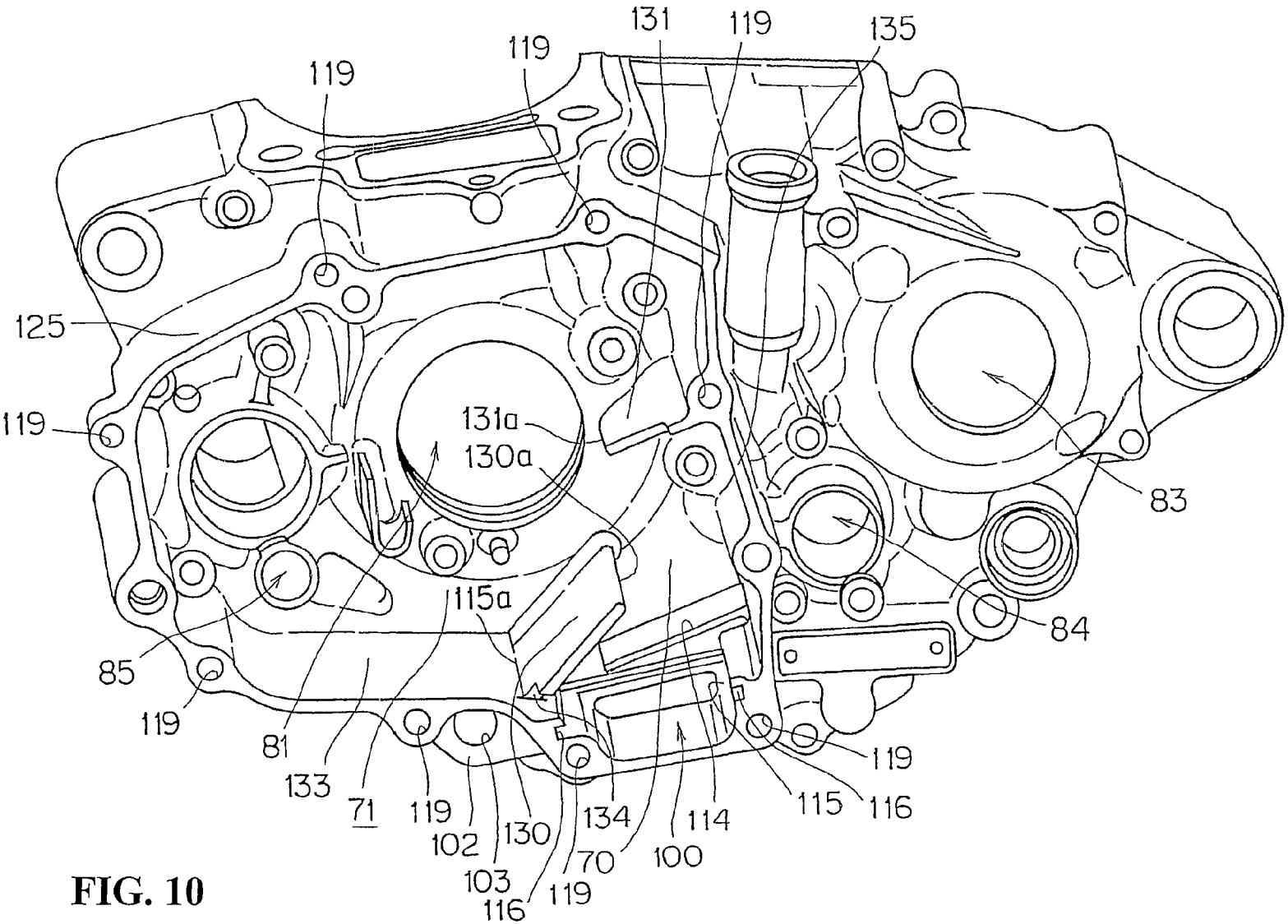
FIG. 10 is a perspective view of the left-side case as viewed from the side opposite to the side of the mating surface.
Figure 11:
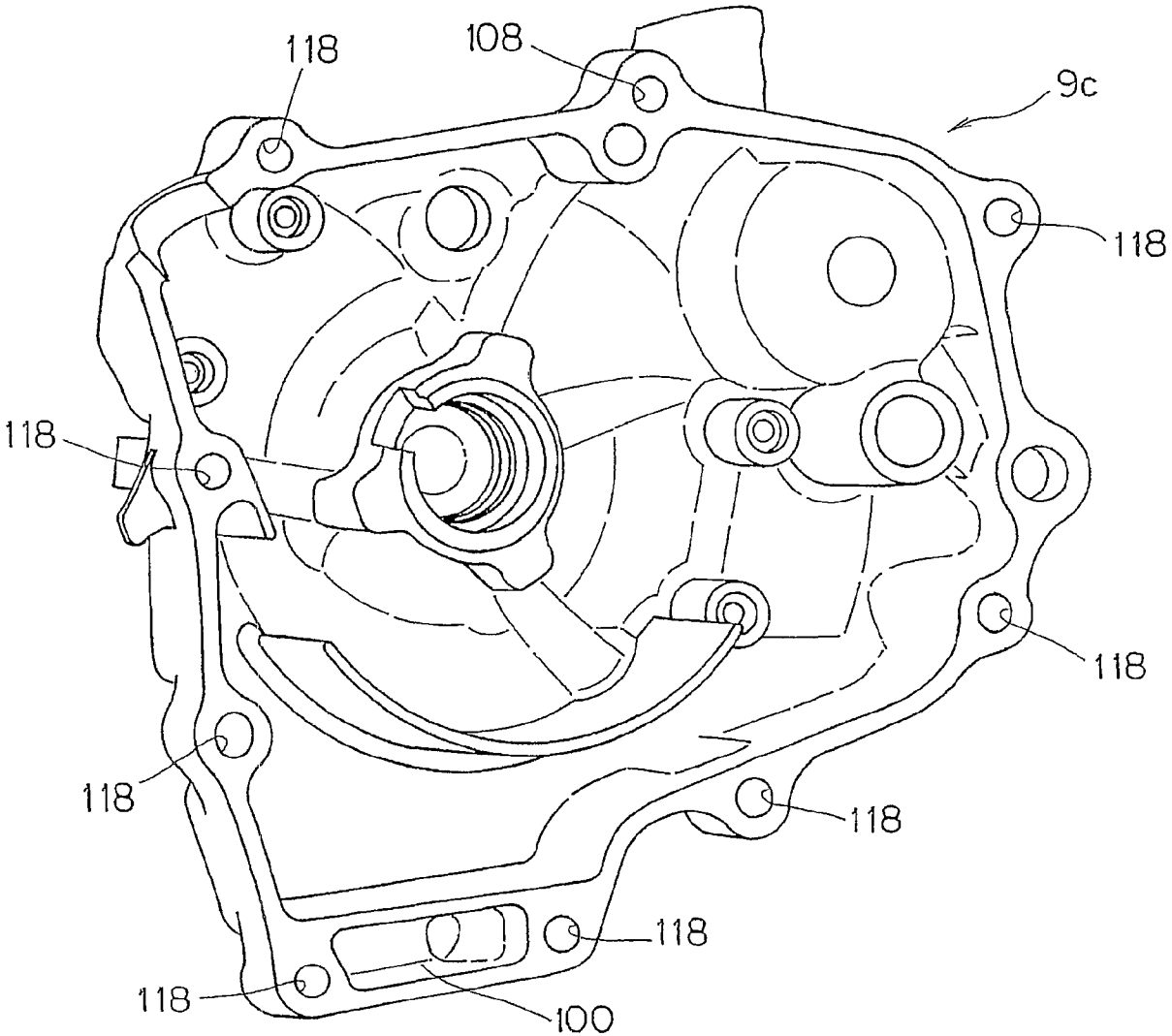
FIG. 11 is a perspective view of a crankcase cover as viewed from the inner side.

In addition, FIG. 8 is a sectional view in the vehicle body width direction of an oil sump chamber 100 in the condition where the right-side and left-side cases 9*a* and 9*b* are mated with each other. FIG. 9 is a perspective view of the right-side case 9*a* as viewed from the mating surface side, and FIG. 10 is a perspective view of the left-side case 9*b* as viewed from the side opposite to the mating surface 80*b*. Further, FIG. 11 is a perspective view of the crankcase cover 9*c* as viewed from the inner side.

The right-side case 9*a* and the left-side case 9*b* are coupled to each other at their mating surfaces 80*a*, 80*b*, whereby the crankcase 9 is assembled. The right-side case 9*a* and the left-side case 9*b* are each provided with a crankshaft mounting part 81, a main shaft mounting part 82, a drive shaft mounting part 83, a shaft drum mounting part 84, an oil pump mounting part 85 and the like in the crank chamber, at corresponding positions in the combined state thereof.

In addition, the right-side case 9*a* and the left-side case 9*b* are provided with the oil sump chamber 100 on the lower side of the crankshaft mounting part 81. More specifically, the oil sump chamber 100 is formed in the manner of ranging across the mating surfaces 80*a*, 80*b* of the right-side case 9*a* and the left-side case 9*b*, and an integral oil sump chamber 100 is formed in the condition where the oil sump chamber 100 formed in the right-side case 9*a* and the oil sump chamber formed in the left-side case 9*b* are combined with each other at the mating surfaces 80*a*, 80*b*.

The oil sump chamber 100 is a chamber in which the oil for lubricating the inside of the engine 7 is reserved. The engine 7 is so designed that the lubricating oil is used while being circulated. The oil reserved in the oil sump chamber 100 is pumped up by the oil pump 86, is supplied to the sliding parts (the crankshaft 40 in the crank chamber, the camshaft 54, the generator 52, etc.) to lubricate the latter, and then flows down by gravity, to again enter the oil sump chamber 100.

The interior of the oil sump chamber 100 is partitioned by a partition wall 110 (with a part on the right-side case 9*a* side being referred to as partition wall 110*a*, and with a part on the left-side case 9*b* side being referred to as partition wall 110*b*) into a first oil sump chamber 111 located on the upper side and a second oil sump chamber 112 located on the lower side.

As shown in FIGS. 6 and 9, the first oil sump chamber 111 of the right-side case 9*a* is provided on the upper side thereof with an inflow port 107 for the oil flowing down from the crankshaft mounting part 81 side. A reed valve 108 (one-way valve) is mounted to the inflow port 107. The reed valve 108 is mounted in the manner of being fitted in a groove part 109 formed at an aperture edge part of the inflow port 107, and is opened and closed according to pressure variations at the time of sliding of the piston inside the sealed crank chamber, thereby preventing the oil from flowing back from the first oil sump chamber 111 side to the crank chamber side under a negative pressure.

In addition, as shown in FIGS. 8 and 9, the inflow port 107 and the reed valve 108 are provided only at the right-side case 9*a*. More specifically, the oil flowing in via the inflow port 107 flows from the right-side case 9*a* side to the left-side case 9*b* side, in the first oil sump chamber 111.

As shown in FIG. 7, the upper side of the first oil sump chamber 111 in the left-side case 9*b* is closed with an upper wall 113. In addition, a wall part 70 on the depth side in FIG. 7 of the first oil sump chamber 111 is provided with an oil outflow port 114. As shown in FIG. 10, the oil outflow port 114 penetrates to the generator chamber 71 side. In addition, as shown in FIG. 10, the generator chamber 71 is provided with an oil introduction port 115 which makes the first oil sump chamber 111 and the second oil sump chamber 112 communicate with each other. The oil introduction port 115 is formed with a groove part 116 in its aperture edge part, and a strainer 117 (see FIG. 8) is mounted in the manner of being fitted in the groove part 116. The strainer 117 also has an effect of removing bubbles contained in the oil.

As shown in FIG. 10, on the outside of the left-side case 9*b*, an outer wall part 125 projecting from the wall part 70 to the side opposite to the side of the mating surface 80*b* is formed in a substantially circular ring-like shape, with the axis of the crankshaft 40 as a center of the circle. The outer wall part 125 is provided in its tip portion with a plurality of mounting holes 119 for attaching the crankcase cover 9*c*. On the other hand, as shown in FIG. 11, the crankcase cover 9*c* is provided in its outer circumferential portion with a plurality of mounting holes 118 at positions corresponding to the mounting holes 119. The crankcase cover 9*c* is attached to the left-side case 9*b* by fastening the mounting holes 118, 119 with bolts. As a result, the generator chamber 71 is defined by the wall part 70, the outer wall part 125, and the crankcase cover 9*c*. In addition, respective left side parts of the first oil sump chamber 111, the second oil sump chamber 112, and the oil introduction port 115 shown in FIG. 10 are covered with the crankcase cover 9*c*, so as to prevent the oil from leaking to the exterior.

This ensures that, as shown in FIG. 8, the oil having moved from the right-side case 9*a* side to the left-side case 9*b* side in the first oil sump chamber 111 flows out to the generator chamber 71 side in the manner of once flowing upward through the oil outflow port 114. With the oil once moved upward in this manner, bubbles contained in the oil are removed. Then, the bubbles are removed at the strainer 117, and thereafter the oil flows into the second oil sump chamber 112.

In addition, the oil reserved in the second oil sump chamber 112 is pumped up into the oil pump 86 through an oil suction passage 101 shown in FIG. 6 and the oil filter 59.

In addition, in FIG. 10, an engine hanger boss 102 for supporting the engine 7 is provided together with a mounting hole 103 of the engine hanger boss 102, a bottom wall 105 of the second oil sump chamber 112, and a front-side end part 106 at which the second oil sump chamber 112 and the oil suction passage 101 communicate with each other.

As shown in FIGS. 10 and 4, the left-side case 9*b* is provided on the generator chamber 71 side with a shielding rib 130 and a guide rib 131 for guiding the flowing-down oil.

The shielding rib 130 extends toward the vehicle body rear upper side from the front-side end part 115*a* (one end part) of the oil introduction port 115. The length of the shielding rib 130 in the vehicle body width direction is so set that the shielding rib 130 extends continuously over the range from the wall part 70 to the crankcase cover 9*c*. The shielding rib 130 is located between the generator 52 and the oil introduction port 115 in side view, as shown in FIG. 4, and is formed in a manner so as to cover the vehicle body front side of the oil introduction port 115 from the upper side, as viewed from the generator 52.

The shielding rib 130 is designed to receive the oil splashed from the generator 52. If the oil splashed from the generator 52 directly impinges on the oil collecting in the oil introduction port 115, bubbles are liable to be generated in the oil during mixing of the portions of the oil. In view of this, the shielding rib 130 is so provided as to prevent the splashed oil from directly impinging on the oil present in the oil introduction port 115. The oil thus received by the shielding rib 130 flows down along the inclination of the shielding rib 130, to be guided to the front-side end part 115*a* of the oil introduction port 115.

On the other hand, the guide rib 131 extends forwardly downwards from a side wall 135 (an outer wall part 125 located on the vehicle body rear side) toward the side of the crankshaft 40. The length of the guide rib 131 in the vehicle body width direction is set so that the guide rib 131 extends continuously over the range from the wall part 70 to the crankcase cover 9*c*. The guide rib 131 is located between the cam chain 53 and the oil introduction port 115 in a side view, as shown in FIG. 4, and is formed in a manner so as to cover the vehicle body rear side of the oil introduction port 115 from the upper side, as viewed from the cam chain 53.

The guide rib 131 is designed so as to receive the oil splashed from the generator chamber 71. More specifically, the oil splashed inside the generator chamber 71 is collected at the guide rib 131, from which the oil drops into the oil instruction port 115, whereby it is made difficult for bubbles to be generated in the oil at the oil introduction port 115.

In addition, the vibration of the cam chain 53 is restrained by a tensioner 132 (see FIG. 4) and a tension pivot 37 (see FIG. 5). At an upper-side portion of the cam chain 53 yet to be meshed with the crankshaft sprocket 56. However, the cam chain 53 is liable to vibrate in the left-side direction, so that the oil deposited on the cam chain 53 is liable to be scattered. Taking this into consideration, a tip part 131*a* in the extension direction of the guide rib 131 is disposed to extend to the position where a straight line in the extension direction intersects a horizontal line S passing through the center axis of the crankshaft 40 (the position substantially level with the position at which the cam chain 53 is meshed with the crankshaft sprocket 56). This ensures that the oil splashed at portions above the horizontal line S can be effectively received by the guide rib 131.

In addition, as shown in FIG. 4, the tip part 131*a* of the guide rib 131 is located on the vehicle body front side in relation to a vertical line V extending upwardly from a tip part 130*a* of the shielding rib 130, and the guide rib 131 is disposed on the upper side of the shielding rib 130 so as to overlap with the shielding rib 130 as viewed in the vertical direction. This ensures that the oil received by the guide rib 131 flows down along the inclination of the guide rib 131, and falls from the tip part 131*a* of the guide rib 131 down onto the shielding rib 130 located on the vertically lower side.

On the other hand, the shielding rib 130 is provided in its base end part with a groove 134 for guiding the oil from a bottom wall 133 to the oil introduction port 115. The groove 134 permits the oil received by the shielding rib 130 to flow therethrough to the oil introduction port 115.

In addition, as shown in FIG. 4, the bottom wall 133 (a lower-side portion of the above-mentioned outer wall part 125) of the generator chamber 71 is formed at a gradual rising inclination from the front-side end part 115*a* (one end side) of the oil introduction port 115 toward the vehicle body front side. More specifically, the oil falling to the lower side of the generator chamber 71 is received by the bottom wall 133, flows along the gradual inclination of the bottom wall 133 into the groove 134, and is then guided to the oil introduction port 115. This inclination is for ensuring that, when the oil received by the bottom wall 133 flows into the groove 134, the oil slowly joins the oil collecting in the oil introduction port 115, whereby the generation of bubbles in the oil due to mutual impingement (collision) of the portions of the oil is prevented from occurring.

According to the internal combustion engine pertaining to the embodiment of the present invention, the shielding rib 130 is provided which is disposed between the generator 52 in the generator chamber 71 and the oil introduction port 115, extends toward the vehicle body rear upper side from the front-side end part 115*a* of the oil introduction port 115, and covers the vehicle body front side of the oil introduction port 115 from the upper side. Therefore, the oil splashed from the generator 52 is shielded by the shielding rib 130, so that the oil splashed from the generator 52 is prevented from directly impinging on the oil collecting in the vicinity of the oil introduction port 115. Accordingly, generation of bubbles in the oil due to mutual impingement (collision) of the portions of the oil can be prevented from occurring.

Further, in addition to the provision of the shielding rib 130, the guide rib 131 is provided which is disposed between the cam chain 53 in the generator chamber 71 and the oil introduction port 115, extends from the side wall 135 of the generator chamber 71 toward the crankshaft 40 side, and covers the vehicle body rear side of the oil introduction port 115 from the upper side. Therefore, the oil splashed inside the generator chamber 71 is collected by the guide rib 131 and drips therefrom down into the oil introduction port 115, whereby generation of bubbles in the oil at the oil introduction port 115 is restrained.

Furthermore, the bottom wall 133 of the generator chamber 71 is formed at a gradual rising inclination from the front-side end part 115*a* of the oil introduction port 115. Therefore, the oil flowing from the bottom wall 133 into the oil introduction port 115 is permitted to slowly join the oil present in the oil introduction port 115. Consequently, generation of bubbles in the oil due to mutual impingement of the portions of the oil can be prevented from occurring.

In addition, the guide rib 131 is disposed above the shielding rib 130 so as to overlap with the shielding rib 130 as viewed in the vertical direction, and the tip part 131*a* in the extension direction of the guide rib 131 is disposed to extend to the position where it intersects the horizontal line S passing through the center axis of the crankshaft 40. Therefore, the oil collected by the guide rib 131 flows down onto the shielding rib 130, to be further collected by the shielding rib 130. Accordingly, the oil can be guided to the oil introduction port 115 while obviating such a strong impingement (collision) that bubbles would mix into the oil. In addition, the guide rib 131 receives the oil splashed during the course of the cam chain 53 coming into mesh with the crankshaft sprocket 56 provided on the crankshaft 40. Therefore, the oil can be received by the guide rib 131 in its course of being splashed most. Consequently, the splashed oil can be prevented from impinging on the oil reserved in the oil sump chamber 100, and the generation of bubbles in the oil can be obviated thereby.

Furthermore, the base end part of the shielding rib 130 corresponding to the front-side end part 115*a* of the oil introduction port 115 is provided with the groove 134 for guiding the oil from the bottom wall 133 to the oil introduction port 115. Therefore, the oil can be slowly guided from the bottom wall 133 into the oil introduction port 115. Consequently, the generation of bubbles in the oil due to the mutual impingement of the portions of the oil can be prevented from occurring.

While one embodiment of the present invention has been described above, various changes and modifications are possible based on the technical thought of the invention.

For example, while the tip part 131*a* of the guide rib 131 is disposed to extend to the position where it intersects with the horizontal line S passing though the center lower side of the position of this intersection with the horizontal line S, whereby the splashed oil can be received by the guide rib 131 more securely.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine comprising:

a generator chamber provided at a side part of a crank chamber and in which a cam chain and a generator are disposed; and an oil sump chamber including an oil introduction port for receiving a lubricating oil coming from said generator chamber for reserving said oil received through said oil introduction port, with the generator being disposed on the upper side of one end side of said oil introduction port, and with a side wall of said generator chamber extending on the upper side of the other end side of said oil introduction port;

wherein said generator chamber includes a shielding rib disposed between said generator and said oil introduction port in a side view, said shielding rib extending skewly upwardly from said oil introduction port in a manner so as to cover one end side of said oil introduction port, and a guide rib extending from said side wall of said generator chamber in a manner so as to cover the other end side of said oil introduction port.

2. The internal combustion engine according to claim 1, wherein a bottom wall of said generator chamber is formed at such an inclination so as to gradually rise from said one end side of said oil introduction port, and said shielding rib is provided with a groove for guiding said oil from said bottom wall to said oil introduction port.

3. The internal combustion engine according to claim 1, wherein said guide rib is disposed to be above said shielding rib in the vertical direction and to overlap with said shielding rib in side view, and is formed at such a downward inclination that an end part in the extension direction of said guide rib is located below the center of a crankshaft.

4. The internal combustion engine according to claim 2, wherein said guide rib is disposed to be above said shielding rib in the vertical direction and to overlap with said shielding rib in side view, and is formed at such a downward inclination that an end part in the extension direction of said guide rib is located below the center of a crankshaft.

5. The internal combustion engine according to claim 1, wherein the guide rib extends forwardly and downwardly from the side wall towards a side of a crankshaft.

6. The internal combustion engine according to claim 1, wherein a length of the guide rib in a vehicle body width direction is set wherein the guide rib extends continuously over a range from the side wall to a crankcase cover.

7. The internal combustion engine according to claim 1, wherein the guide rib receives oil splashed inside the generator chamber to collect the oil on the guide rib for enabling the oil to drop into the oil introduction port for reducing bubbles from being generated in the oil at the oil introduction port.

8. The internal combustion engine according to claim 2, wherein the generator chamber includes a gradual inclination bottom wall wherein oil flows along the bottom wall into the groove in the shielding rib for being guided to the oil introduction port.

9. The internal combustion engine according to claim 1, wherein said shielding rib extends towards a vehicle body rear upper side from a front-side end part of the oil introduction port and covers a vehicle body front side of the oil introduction port from an upper side.

10. The internal combustion engine according to claim 9, wherein oil splashed from the generator is prevented from directly impinging on oil collecting in the vicinity of the oil introduction port for preventing bubbles in the oil by avoiding mutual impingement of portions of the oil.

11. An internal combustion engine comprising:

a generator chamber formed in a crank chamber;

a cam chain and a generator being operatively mounted within said generator chamber;

an oil sump chamber formed in a lower portion of said generator chamber;

an oil introduction port in communication with said oil sump chamber, said oil introduction port receives lubricating oil coming from said generator chamber for supplying the oil to the oil sump chamber, said generator being disposed on the upper side of one end side of said oil introduction port, and with a side wall of said generator chamber extending on the upper side of the other end side of said oil introduction port;

a shielding rib formed in said generator chamber, said shielding rib being disposed between said generator and said oil introduction port in a side view, said shielding rib extending skewly upwardly from said oil introduction port to cover one end side of said oil introduction port; and a guide rib formed in said generator chamber, said guide rib extending from said side wall of said generator chamber for covering a second end side of said oil introduction port.

12. The internal combustion engine according to claim 11, wherein a bottom wall of said generator chamber is formed at such an inclination so as to gradually rise from said one end side of said oil introduction port, and said shielding rib is provided with a groove for guiding said oil from said bottom wall to said oil introduction port.

13. The internal combustion engine according to claim 1, wherein said guide rib is disposed to be above said shielding rib in the vertical direction and to overlap with said shielding rib in side view, and is formed at such a downward inclination that an end part in the extension direction of said guide rib is located below the center of a crankshaft.

14. The internal combustion engine according to claim 12, wherein said guide rib is disposed to be above said shielding rib in the vertical direction and to overlap with said shielding rib in side view, and is formed at such a downward inclination that an end part in the extension direction of said guide rib is located below the center of a crankshaft.

15. The internal combustion engine according to claim 11, wherein the guide rib extends forwardly and downwardly from the side wall towards a side of a crankshaft.

16. The internal combustion engine according to claim 11, wherein a length of the guide rib in a vehicle body width direction is set wherein the guide rib extends continuously over a range from the side wall to a crankcase cover.

17. The internal combustion engine according to claim 11, wherein the guide rib receives oil splashed inside the generator chamber to collect the oil on the guide rib for enabling the oil to drop into the oil introduction port for reducing bubbles from being generated in the oil at the oil introduction port.

18. The internal combustion engine according to claim 12, wherein the generator chamber includes a gradual inclination bottom wall wherein oil flows along the bottom wall into the groove in the shielding rib for being guided to the oil introduction port.

19. The internal combustion engine according to claim 11, wherein said shielding rib extends towards a vehicle body rear upper side from a front-side end part of the oil introduction port and covers a vehicle body front side of the oil introduction port from an upper side.

20. The internal combustion engine according to claim 19, wherein oil splashed from the generator is prevented from directly impinging on oil collecting in the vicinity of the oil introduction port for preventing bubbles in the oil by avoiding mutual impingement of portions of the oil.

* * * * *